United States Patent [19]

Fujio et al.

[11] Patent Number: 4,694,633

[45] Date of Patent: Sep. 22, 1987

[54] FILM WRAPPING MACHINE

[75] Inventors: Masaaki Fujio, Suita; Tetsuhiro Yamamoto, Hirakata, both of Japan

[73] Assignee: Fuji Seal Industry Co., Ltd., Osaka, Japan

[21] Appl. No.: 929,500

[22] Filed: Nov. 10, 1986

[30] Foreign Application Priority Data

May 21, 1985 [JP] Japan ..... 60-109982
May 20, 1986 [JP] Japan ..... 61-116565
May 20, 1986 [JP] Japan ..... 61-116566

[51] Int. Cl.[4] ..... B65B 21/26; B65B 11/56

[52] U.S. Cl. ..... 53/49; 53/128; 53/211; 53/587; 156/86; 156/215

[58] Field of Search ..... 53/49, 211, 587, 216, 53/465, 128, 139.3, 399; 156/86, 215

[56] References Cited

U.S. PATENT DOCUMENTS 1,245,561 11/1917 Braecklein ..... 53/49 X
2,109,505 3/1938 Rue et al. ..... 53/49
3,056,246 10/1962 Lyon et al. ..... 53/49
3,659,394 5/1972 Hartleib et al. ..... 53/216 X
3,716,964 2/1973 Reynolds et al. ..... 53/211 X
3,851,443 12/1974 Fine ..... 53/211 X
4,016,706 4/1977 Braker et al. ..... 53/49 X
4,103,692 8/1978 Baier et al. ..... 53/211 X
4,245,452 1/1981 Fujio ..... 53/399
4,350,002 9/1982 Focke ..... 53/49 X

*Primary Examiner*—Horace M. Culver
*Attorney, Agent, or Firm*—Lackenbach Siegel Marzullo & Aronson

[57] ABSTRACT

A film wrapping machine for wrapping a film around a container comprising a rotary turntable assembly for transporting containers from one station to another. The machine includes a film supply unit for supplying each film onto a respective container carried by the turntable assembly, and a plurality of film retaining members one for each container carried by the turntable assembly. During the rotation of the turntable assembly, the film retaining meers are successively lifted to a raised position and are then rotated around the respective containers for turning the films therearound. Each film retaining member has suction openings defined therein in at least two rows, one row of the suction openings being adapted to suck one end of the respective film and the other row of the suction openings adapted to such a portion of the respective film adjacent the other end thereof. Rotation of the film retaining member results in the turning of the respective film around the associated container to form the film tube. This sequence takes place during the rotation of the turntable assembly while the containers are successively transported thereby.

5 Claims, 12 Drawing Figures

I
II
III
IV
V
VI
VII
100
101
102
152
154
170
171
31
32
35
37
50
51
52
70
215
X
F
F1
F2
FR
a

FILM WRAPPING MACHINE

BACKGROUND OF THE INVENTION 1. (Field of Technology)

The present invention relates to a film wrapping machine for wrapping articles with films, particularly heat-shrinkable films.

The articles which the film wrapping machine according to the present invention can handle may be any type of container such as, for example, bottles, cans or cups of any shape, for example, either cylindrical or round. The films which the film wrapping machine according to the present invention utilizes may be a protective film for minimizing any possible scattering of fragments of the container when the latter is broken or for minimizing the unauthorized opening of the container by persons other than the purchaser, or a decorative film for aesthetic purpose or for presenting commercials associated with the contents in the container.

2. (Description of the Prior Art)

It has been widely practised to wrap containers or the like with heat-shrinkable films for the purpose of protection and/or decoration. It has also been practiced to wrap the necks and the caps of the containers together with the heat-shrinkable films for the purpose of avoiding any possible accidental separation of the caps from the necks. Whatever the purpose is, the wrapping of a heat-shrinkable film cut from a roll of film into a predetermined size is hitherto carried out by turning it around a container with its opposite ends overlapping with each other, then fusionbonding the overlapping ends of the film together to form a film tube surrounding the container, and subjecting the container with the film tube to a heat-treatment so that the film tube can shrunk to fit to the container.

A film wrapping machine capable of performing the above described wrapping method is disclosed in, for example, the U.S. Pat. No. 4,245,452, issued Jan. 20, 1981, to the same assignee of the present invention, an essential portion of which machine is reproduced in FIG. 9 of the accompanying drawings for the purp the purpose of discussion of the prior art.

Referring to FIG. 9, reference numeral 300 represents a rotary turntable assembly adapted to be driven in one direction, shown by the arrow, about a support shaft 400 for transporting containers X successively from and back to an article supply station. Reference numeral 301 represents a plurality of article holders rigidly mounted on an outer peripheral portion of the rotary turntable assembly 300 in equally spaced relationship with respect to the circumferential direction of the rotary turntable assembly 300, each of said article holders 301 having a recess 302 defined therein for the receipt of the respective container X. Reference numeral 303 represents a pair of film wrapping arms carried by each article holder 301 for pivotal movement between opened and closed positions and operable to turn the film F generally around the respective container X then received in the recess 302 of the associated article holder 301. Reference numeral 304 represents a pair of follow-up arms movably carried by each article holdere 301 and operable to assist the film wrapping in association with the respective film wrapping arms 303. Reference numeral 305 represents a film supporting spatula provided for each article holder 301 and adapted to be held in contact with the side wall of the respective container X.

Although not shown, the prior art film wrapping machine also comprises a cam mechanism so designed as to permit all of the pairs of the film wrapping arms 303 and all of the pairs of the follow-up arms 304 to be successively moved between the opened and closed positions during the rotation of the rotary turntable assembly 300 about the support shaft 400 past a particular processing station and also as to permit all of the film supporting spatulas 305 to be moved up and down in synchronism with the movement of the respective pair of the film wrapping arms 303 between the opened and closed positions.

The prior art film wrapping machine of the above described construction opereates in the following manner, Assuming that the heat-shrinkable film F is supplied into the empty recess 302 in the associated article holder 301 and the respective container X is subsequently supplied onto such recess 302 with the film F positioned radially outwardly of the container X, the associated film supporting spatula 305 is lowered from above to a position where it is brought into contact with the side wall of the container X. Simultaneously therewith, the associated pair of the film wrapping arms 303 and the associated pair of the follow-up arms 304 are sequentially moved from the opened position towards the closed position to encompass the container X whereby the film F positioned inside the recess 302 and surrounding the container X in the article holder 301 is turned around the container with its opposite ends overlapping with each other and also with the film supporting spatula 305. The overlapping ends of the film F which are also overlapping the film supporting spatula 305 are then applied with an adhesive and are clamped together by a presser head pressing the overlapping ends of the film F against the film supporting spatula 305. In this way, the film F can be completely wrapped around the container with the overlapping ends thereof bonded together, and thereafter, the container having the film tube is removed out of the associated recess 302 in the article holder 301 for the transportation to the next subsequent processing station located exteriorly of the rotary turntable assembly 300.

It has subsequently been found that the prior art film wrapping machine of the type described above has a problem in that, when the film wrapping arms 303 of each pair are pivoted to the closed position to encompass the respective container X with the film turned therearound, the opposite ends of the film F are often overlapped with each other in a manner displaced in a direction longitudinally of the container X and/or slackened. Also, the necessity of each of the film supporting spatulas 305 to be moved up and down in association with the movement of the associated film wrapping arms brings about another problem in that not only is the film wrapping machine rendered to be complicated in structure, but also a high film wrapping capability is hampered.

SUMMARY OF THE INVENTION

Accordingly, the present invention has been developed with a view to substantially eliminating the above discussed problems inherent in the prior art film wrapping machine and has for its essential object to provide an improved film wrapping machiane which is effective to automatically wrap the films successively around the articles with no possibility of the overlapping ends of each film being displaced.

Another important object of the present invention is to provide an improved film wrapping machine of the type referred to above, which is reliable in operation and capable of handling the articles at high speed for wrapping the films around the articles.

A further object of the present invention is to provide an improved film wrapping machine of the type referred to above, which can handle the articles of any shape if they can support themselves on, for example, a surface.

In order to accomplish these objects of the present invention, a film wrapping machine for successively turning films around articles so as to form a film tube encircling each article according to a preferred embodiment of the present invention comprises a rotary turntable assembly supported for rotation in one direction about a support shaft and movable from and back to an article supply station past a film supply station and an article delivery station during one complete rotation thereof, all of said stations being disposed in the vicinity of the periphery of of the rotary turntable assembly; a plurality of article supports provided in the rotary turntable assembly at a peripheral portion thereof for rotation together with said rotary turntable assembly about the support shaft and spaced an equal distance from each other in a direction circumferentially of the rotary turntable assembly, each of said article support being operable to carry the respective article for transporting from the article supply station towards the article delivery station; an article supply unit disposed at the article supply station for supplying the articles successively onto the respective article supports in the rotary turntable assembly as the rotary turntable assembly during the rotation thereof arrives at the article supply station; and a film retaining member provided for each article support and supported in the vicinity of the respective article support for rotation about an axis parallel to the support shaft between inoperative and operative positions and also for movement in a direction parallel to the support shaft between raised and lowered positions.

The film retaining member has suction openings defined therein in at least two leading and trailing rows, the leading and trailing rows of the suction openings being spaced a predetermined distance from each other in a direction conforming to the direction of rotation of the film retaining member. The leading row of the suction openings is adapted to retain a leading end of the associated film by the effect of a suction force whereas the trailing row of the suction openings is adapted to retain a trailing end of such associated film by the effect of a suction force. The film retaining member is rotated about the associated article on the article support from the inoperative position towards the operative position only when and after it has been moved from the lowered position towards the raised position.

The film wrapping machine also comprises a film supply unit disposed at the film supply station for supplying the film onto the respectice film retaining member each time the rotary turntable assembly is brought to the film supply station, said film retaining member being moved from the lowered position to the raised position upon the arrival of the rotary assembly at the film supply station such that the leading end of the film can be sucked by the leading row of the suction openings by the effect of the suction force, the film with its leading end sucked by the leading row of the suction openings being exteriorly turned around the associated article as the film retaining member is rotated from the inoperative position towards the operative position, said film being completely turned around the associated article with a portion of the film adjacent the trailing end sucked by the trailing row of the suction openings permitting the trailing end to overlap the leading end; a heater unit provided for each article support and carried by the rotary turntable assembly for movement between projected and retracted positions in a direction close towqards and away from the associated article on the article support, said respective heater unit being moved from the retracted position to the projected position in unison with the movement of the associated film retaining member from the inoperative position to the operative position, said heater unit when moved to the projected position being pressed against the associated film retaining member with the overlapping ends of the film around the article consequently fusion-bonded together to complete a film tube; and an article delivery unit disposed at the article delivery station for removing the articles with the respective film tube successively out from the associated article supports as the rotary turntable assembly during its continued rotation is brought to the article delivery station.

Preferably, the film retaining member comprises a film retaining spatula having a hollow defined therein and adapted to be communicated with a source of vacuum, and said leading and trailing rows of the suction openings being defined in communication with the hollow on one surface of the film retaining spatula facing in a direction opposite to the associated article.

Preferably, the film retaining spatula comprises a pair of generally strip-like plates connected together in face-to-face relationship with each other, one of said plates having at least one recess defined therein while the other of the plates having the rows of the suction openings defined therein, said recess forming the hollow when the plates are connected together.

With the film wrapping machine so constructed, when the rotary turntable assembly being rotated arrives at a film supply station, the film retaining member is moved from the lowered position to the raised position in readiness for the receipt of the respective fiml from the film supply unit. At this time, the leading row of the suction openings in the film retaining member is aligned with the leading end of the film and then picks up the leading end of the film by the effect of the suction force, removing the film from the film supply unit as the film retaining member in the raised position is rotated from the inoperative position towards the operative position. The film so removed from the film supply unit is, during the continued rotation of the film retaining member towards the operative position, turned around the associated article until that portion of the film adjacent the trailing end thereof is sucked onto the trailing row of the suction openings in the film retaining member.

When that portion of the film adjacent the trailing end is thus sucked onto the trailing row of the suction openings in the film retaining member which has completed a substantially 360° rotation on the way towards the operative position, the trailing end of the film overlaps the leading end thereof while the remaining portion of the film encircles the respective article. The overlapping ends of the film are, during the continued rotation of the rotary turntable assembly from the film supply station towards the article delivery station and after the film retaining member has been rotated to the operative position, fusion-bonded or welded together to complete the film tube surrounding the article.

According to another preferred embodiment of the present invention, the film wrapping machine of the construction described above is further provided with a plurality of foldable erecting members for each film retaining member and similar in shape to the associated film retaining member. The foldable erecting members for each film retaining member are supported for movement together with the associated film retaining member, but are held in a folded condition when the associated film retaining member is in the lowered position and also in the inoperative position. These foldable erecting members are unfolded as the associated film retaining member is moved from the inoperative position towards the operative position about the associated article, said foldable erecting member when unfolded being spaced a distance from each other in a direction circumferentially of the associated article to support the film turned exteriorly around the associated article.

The film wrapping machine according to the second preferred embodiment of the present invention functions substantially in a manner identical with that according to the first preferred embodiment thereof. However, the additional use of the foldable erecting members brings about such an effect that, even if each article is of a design comprising, for example, a radially outwardly swelling body and a slender neck of progressively decreasing outer diameter continued from the swelling body, the film turned therearound can be supported by the unfolded and, therefore, circumferentially equally spaced erecting members without being slackened due to its flexibility, permitting the film to represent a generally cylindrical shape with the article positioned inside the film. This is possible because the foldable erecting members are unfolded to assume respective positions spaced a generally equal distance circumferentially around the article as the film retaining member undergoes a substantially 360° rotation from the inoperative position towards the operative position.

According to a third preferred embodiment of the present invention, instead of the film retaining member, the use is made of a film retaining barrel. The film retaining barrel is provided for each article support and supported in the vicinity of the respective article support for rotation about an axis parallel to the support shaft between inoperative and operative positions and also for movement in a direction parallel to the support shaft between raised and lowered positions. As is the case with the film retaining member, the film retaining barrel has suction openings defined therein in at least two leading and trailing rows, the leading and trailing rows of the suction openings being spaced a predetermined distance from each other in a circumferential direction thereof. The leading row of the suction openings is adapted to retain a leading end of the associated film by the effect of a suction force whereas the trailing row of the suction openings is adapted to retain a trailing end of such associated film by the effect of a suction force. The film retaining barrel of the above construction is rotatable about the associated article on the article support from the inoperative position towards the operative position only when and after it has been moved from the lowered position towards the raised position.

In the machine according to the third embodiment of the present invention, the film is turned around each article with the film retaining barrel positioned between the article and the film. However, after the overlapping ends of the film have been fusion-bonded or welded together, the film retaining barrel is withdrawn from the raised position towards the lowered position, leaving the complete film tube in the form as surrounding the article.

In any event, the provision of the unique film retaining member or the unique film retaining barrel according to the present invention has made it possible to form the film tube around the respective article with no possibility of the overlapping ends of the film displaced in a direction longitudinally of the article such as occurring in the prior art film wrapping machine. Should the overlapping ends of the film are bonded together while displaced, and when the film tube so formed, that is, the film with its overlapping ends welded together, is subsequently heatshrunken to fit the shape of the respective article, not only does the resultant article completely wrapped with the film fail to provide an aesthetic beauty, but also a subsequent trimming process station would be required to cut a portion of each side edge of the film adjacent one of the opposite ends which is displaced outwardly from that of the other of the opposite ends of the same film.

Also, the use of the foldable erecting members such as in the machine according to the second preferred embodiment of the present invention is advantageous in that the film being turned, or turned, around the respective article can be supported with no possibility of being slackened. Therefore, where each article to be handled by the machine according to the present invention is, for example, a container made of magnetizeable metallic material or synthetic resin, and in the event that electrostatic attraction tends to occur between the container and the film being turned or turned, the film being turned or turned can be so kept by the foldable erecting members that the subsequently formed film tube can assume a generally cylindrical shape.

It is to be noted that the film retaining barrel used in the machine according to the third preferred embodiment of the present invention has a dual function, that is, a combination of the function accomplished by the film retaining member and that accomplished by the foldable erecting members.

BRIEF DESCRIPTION OF THE DRAWINGS

The present invention will become more clearly understood from the following description of preferred embodiments, when taken in conjunction with the accompanying drawings. However, the embodiments and the drawings are given for the purposes of illustration and explanation only, and are not to be taken as being limitative of the present invention in any way whatsoever, whose scope is to be determined solely by the appended claims. In the drawings, like reference numerals denote like parts in the several, and:

FIG. 4(*b*) is a schematic side view showing the sequence of film wrapping in timed relationship with that shown in FIG. 4(*a*);

DESCRIPTION OF THE PREFERRED EMBODIMENTS

Figure 1:
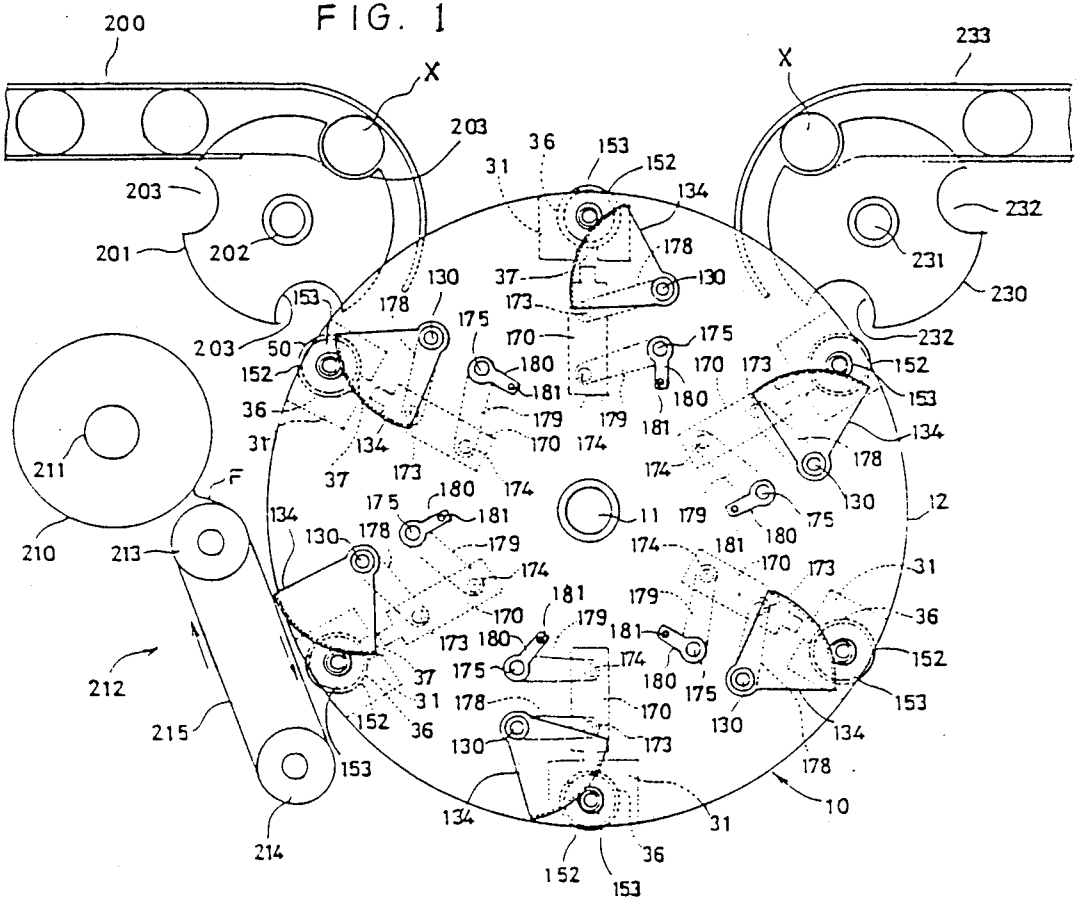
FIG. 1 is a schematic top plan view of a film wrapping machine according to a first preferred embodiment of the present invention.

A film wrapping machine, i.e., a machine for automatically wrapping articles, for example, cylindrical containers X, successively with respective films, according to a first preferred embodiment of the present invention will now be described with reference to FIGS. 1 to 4. The film wrapping machine shown therein comprises a rotary turntable assembly 10 for the transportation of the cylindrical containers X to be wrapped, which rotary turntable assembly 10 is, during one complete rotation thereof in a manner as will be described later, movable from and back to an article receiving station past a plurality of processing stations including an article delivery station, all of these stations being defined in the vicinity of and radilly outwardly of the turntable assembly 10.

The rotary turntable assembly 10 comprises an upright support shaft 11 rotatably mounted on any suitable support surface, for example, a machine base, an upper, an intermediate and a lower circular turntables 12, 13 and 14 rigidly mounted on the support shaft 11 for rotation in a horizontal plane together therewith and spaced a distance from each other in a direction axially of the support shaft 11. While the support shaft 11 may be supported in any manner, for example, by means of one or more machine frames, the support shaft 11 so far shown has a lower end rotatably received in a bearing box through, for example, roller bearings 16. The intermediate turntable 13 has its outer peripheral portion formed with a plurality of, for example, six, circular cutouts 17 equally spaced from each other in a direction circumferentially of the turntable 13.

The film wrapping machine also comprises article supports equal in number to the number of the circular cutouts 17 in the intermediate turntable 13 and generally identified by 30. All of the article supports 30 are of identical construction, and each article 30 comprises an article receiving block 31 rigidly secured at its opposite ends to the upper and lower turntables 12 and 13, and a rotatable mount 32 for the support of the respective cyclindrical coantainer X.

The rotatable mount 32 of each article support 30 is rotatably received in the respective circular cutout 17 in the intermediate turntable 13 through any suitable bearing 34 for rotation in a plane perpendicular to, and about an axis parallel to, the support shaft 11. For the purpose as will become clear from the subsequent description, each rotatable mount 32 has a generally arcuate opening 35 extending completely across the thickness thereof, said arcuate opening 35 providing a respective passage through which an associated film retaining spatula 50 can move in a direction parallel to the support shaft 11.

Each of the article receiving block 31 has a surface area facing radially outwardly of the intermediate turntable 13, which surface area is recessed radially inwardly of the intermediate turntable 13 so as to define a generally U-shaped space 36 which opens radially outwardly of the intermediate turntable 13 and which is so curved as to follow the curvature of the cross-sectional contour of each cylindrical container X to be handled by the machine so that, when the cylindrical container X is placed on the associated rotatable mount 32 as will be described later, the outer peripheral wall of the cylindrical container X so mounted can be partially received in the generally U-shaped space 36 delimited by the radially inwardly recessed surface area. Also, each article receiving block 32 is formed with a vertically extending slot 37 of predetermined width opening across the wall of the respective article receiving block 32 in a direction radially of the intermediate turntable 13 for defining a radial path for the passage therethrough of a respective presser head 171 which will be described later, it being, however, to be noted that each presser head 171 is movable between a radially inwardly retracted position, at which the head 171 is retracted out of the associated slot 37, and a projected position at which the head 171 is brought into contact with the film retaining spatula 50.

Figure 3:
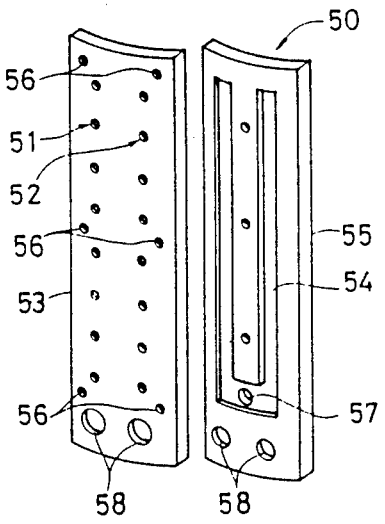
FIG. 3 is an exploded view of one of the film retaining spatulas used in the film wrapping machine shown in FIG. 1.

As best shown in FIG. 3, each retainer spatula 50 comprises a generally rectangular outer plate 53 having a plurality of, for example, two, rows of suction perforations 51 and 52 defined therein in a direction lengthwise thereof and an inner plate 55 similar in shape to the outer plate 53 and having a surface area adjacent the outer plate 53 formed with a generaly U-shaped recess 54. The outer and inner plates 53 and 55 are generally arcuately curved about an axis parallel to the lenghwise direction thereof so as to follow the curvature of the cross-sectional contour of the cylindrical container X and are connected together in face-to-face relationship with each other by means of a plurality of set screws (not shown) passed through screw holes 56 in the outer plate 53 and then threaded firmly to the inner plate 55. In this assebled condition, portions of the U-shaped recess 54 which correspond in position to the arms of the shape of the figure "U" assumed by such recess 54 are aligned with the respective rows of the suction perforations 51 and 52. For the purpose which will become clear from the subsequent description, the U-shaped recess 54 in the retainer spatula 50 is fluid-connected with a source of vacuum through any suitable tubing by way of a valving mechanism operable to selectively interrupt and initiate the supply of a vacuum to the retainer spatula 50.

It is to be noted that, instead of the use of the rows of the suction perforations 51 and 52, at least one slit may be employed for each of that portions of the recess 54 which correspond in position to the arms of the shape of the figure "U" assumed by the recess 54.

The film retaining spatula 50 is rigidly mounted on a hollow shaft 70 having a center hollow 71 defined therein in an axial direction thereof, said center hollow 71 forming a suction passage through which the U-shaped recess 54 is communicated with the vacuum source (not shown). More specifically, the retaining spatula 50 has a perforation 57 defined in the inner plate 55 thereof in communication with the U-shaped recess 54, and is secured at a lower end thereof to a coupling member 72 having a connecting passage 73 defined therein with the perforation 57 communicated with one end of the connecting passage 73. The coupling member 72 is in turn mounted rigidly on an upper end of the hollow shaft 70 with the opposite end of the connecting passage 73 held in communication with the center hollow 71. In securing the film retaining spatula 50 to the coupling member 72, two set screws are passed through screw holes 58, defined in the outer and inner plates 53 and 55 as best shown in FIG. 3, and then firmly threaded to the coupling member 72.

The hollow shaft 70 for each rotatable mount 32 for the support of the respective cylindrical container x is supported for rotation about its own longitudinal axis and also for movement between raised and lowered positions in a direction axially thereof. For this purpose, a tubular guide assembly 90 is provided, which comprises an outer barrel 91 rigidly mounted on the lower circular turntable 14 so as to extend completely through the thickness of the lower turntable 14 in alignment with the respective circular cutout 17 in the intermediate turntable 13, and an inner barrel 93 coaxially received within the outer barrel 91 for rotation relative to the outer barrel 91 and retained in position within the outer barrel 91 by a plurality of bearings 92. The hollow shaft 70 slidably extends through the inner barrel 93 for axial movement relative to the inner barrel 93, but is rotatably together with the inner barrel 93 because the hollow shaft 70 has its outer peripheral surface formed with at least one axially splined groove in which a corresponding key 94 rigid with the inner barrel 93 is engaged. Connection of the lower end of the hollow shaft 70 with the vacuum source (not shown) is carried out by means of a flexible tubing 74 having one end fluid-connected to the lower end of the hollow shaft 70 by means of a rotary coupler 75 of any known construction so designed as to permit the rotation of the hollow shaft 70 relative to the rotary coupler 75 while maintaining a fluid connection therebetween.

For moving each hollow shaft 70 up and down between the raised and lowered positions for the purpose which will be described later, a cam barrel 100 is rigidly mounted on the support surface in coaxial relationship with the support shaft 11, the top of which is formed into a cam surface 101 of a predetermined profile required to move the hollow shaft 70 up and down during the rotation of the turntable assembly 10 as will be described later. A carrier block 103 for each hollow shaft 70 is mounted on the lower end of the respective hollow shaft 70 for movement together with the hollow shaft 70 in an axial direction of the hollow shaft 70, but for rotation relative thereto by means of one or more bearings 105, and carries a roller 102 rotatably mounted thereon by means of a horizontally extending shaft 104. The roller 102 so supported by the carrier block 103 rests on the cam surface 101 and can roll thereover as the turntable assembly 10 rotates. The carrier block 103 has a vertically extending guide hole 106 through which a depending guide rod 107 having one end rigidly secured to the lower turntable 14 extends slidably so that the up-and-down movement of the carrier block 103 and, hence, the hollow shaft 71 resulting from the rolling of the roller 103 on the profiled cam surface 100 incident to the rotation of the turntable assembly 10 can be advantageously stabilized.

A turntable drive mechanism for driving the turntable assembly 10 about the support shaft 11 comprises an externally toothed ring gear 120 having its outer periphery, formed with gear teeth, and coaxially secured to the outer periphery of the lower turntable 14 so as to permit the toothed outer periphery thereof to partially protrude radially outwardly therefrom. The turntable drive mechanism also comprises a drive gear 121 positioned radially outwardly of and in the vicinity of the lower turntable 14 and constantly meshed with the externally toothed ring gear 120, said drive gear 121 being drivingly coupled with an electric motor (not shown) by way of any suitable drive transmission system including a reduction gear unit (also not shown). Accordingly, it will readily be seen that during, the rotation of the drive gear 121 driven by the electric motor, a drive is transmitted to the lower turntable 14 and, hence, the turntable assembly 10 as a whole and, therefore, the turntable assembly 10 is rotated about the support shaft 11.

Each hollow shaft 70 can be rotated together with the inner barrel 93 of the tubular guide assembly 90 by a drive transmitting shaft 130 rotatably extending through the intermediate turntable 13 in a direction perpendicular thereto and having upper and lower end portions thereof journalled to the upper and lower turntables 12 and 14, respectively, by means of associated bearings 131 and 132, it being, however, that the lower end of the drive transmiting shaft 130 protrudes further downwards from the lower turntable 14 and is provided with a sector gear 133 rigidly secured thereto for swinging motion in a plane perpendicular to the drive transmitting shaft 130. The sector gear 133 is in turn drivingly engaged with a pinion gear 94 integrally formed with, or otherwise rigidly mounted on, a lower end of the inner bareel 93 which extends outwardly from the outer barrel 91 in a direction downwards as viewed in FIG. 2.

Figure 2:
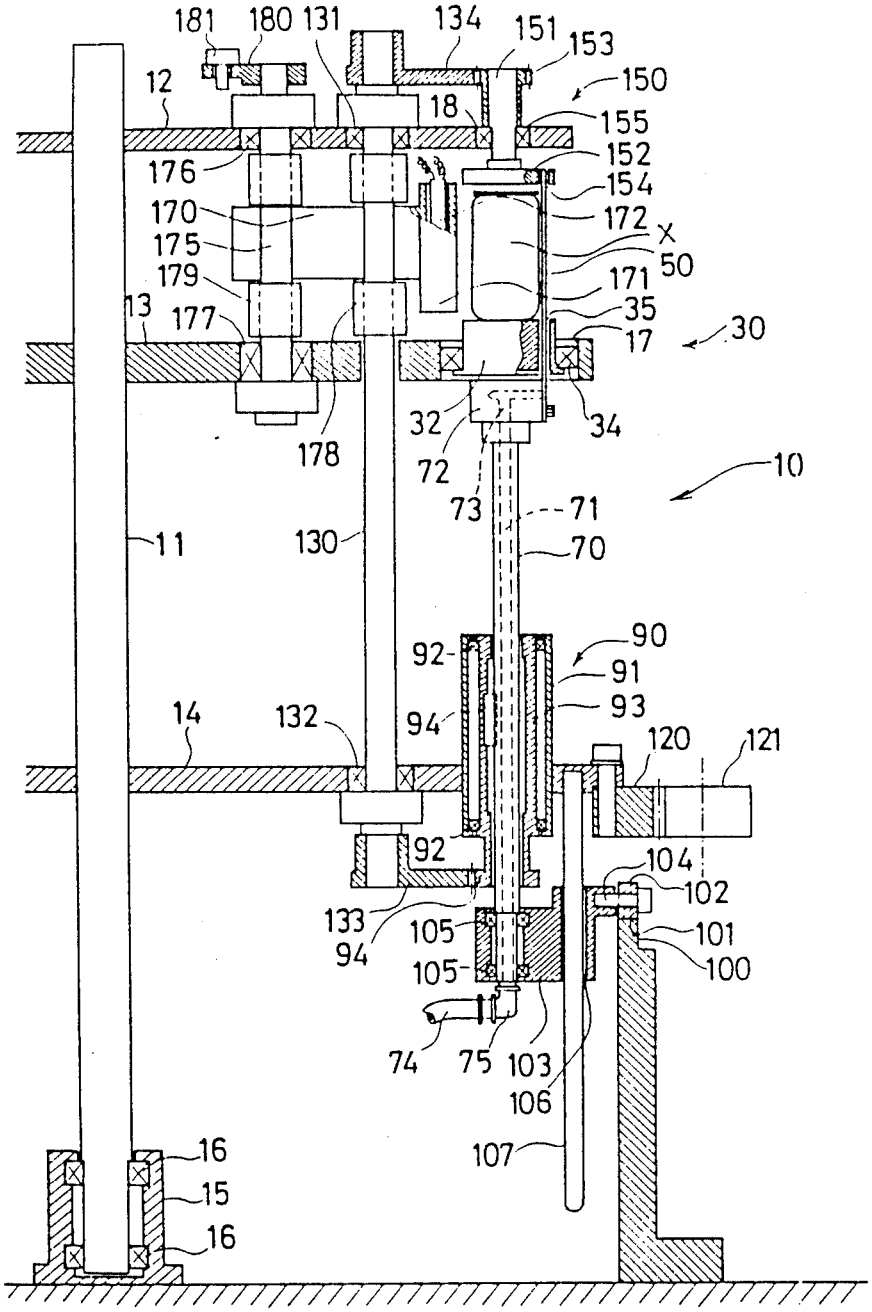
FIG. 2 is a longitudinal sectional view of a portion of the film wrapping machine shown in FIG. 1.

The drive transmitting shaft 130 is adapted to be driven about its own longitudinal axis by a susitable drive mechanism (not shown) in opposite directions one at a time in synchronism with the rotation of the turntable assembly 10 about the support shaft 11 so that the hollow shaft 70 can be rotated in opposite directions one at a time about its own longitudinal axis together with the inner barrel 93 of the tubular guide assembly 90. The rotation of the hollow shaft 70 effected in the manner as hereinabove described brings about a revolution of the film retaining spatula 50, rigidly mounted on the upper end of the hollow shaft 70 through the coupling member 72 as hereinbefore described, between an inoperative position, at which the film retaining spatula 50 is positioned on one side of the container X on the rotary mount 32 remote from and generally 180° spaced from the slot 37 in the associated article receiving block 31 as shown in FIG. 2, and an operative position at which the same retaining spatula 50 is positioned in front of the slot 37. Specifically, when the hollow shaft 70 is rotated about its own longitudinal axis in one of the opposite directions, for example, in a first direction, the spatula 50 is moved about the longitudinal axis of the cylindrical container X, placed on the rotary mount 32, for the inoperative position towards the operative position in a counterclockwise direction as viewed in FIG.

1, but when the hollow shaft 70 is rotated in the other of the opposite direction, say, in a second direction, the spatula 50 is moved about the longitudinal axis of the same container X on the rotary mount 32 from the operative position towards the inoperative position in a clockwise direction as viewed in FIG. 1.

Positioned above the upper turntable 12 for each rotary mount 32 is a spatula holder 150 which comprises a shaft 151 extending through a hole 18, defined in the upper turntable 12, in a direction perpendicular thereto and supported thereby for rotation about its own longitudinal axis through a bearing 155, and a disc 152 rigidly secured to a lower end of the shaft 151 for rotation together therewith. The disc 152 has its peripheral portion recessed radially inwardly thereof to define a holder recess 154 for receiving therein an upper end of the film retaining spatula 50 when the hollow shaft 70 is upwardly shifted from the lower position to the raised position as will be described later. An upper end of the shaft 151 has a pinion gear 153 rigidly mounted thereon, which pinion gear 153 is constantly meshed with a sector gear 134 that is rigidly mounted on an upper end of the drive transmitting shaft 130 and positioned above the upper turntable 12. Accordingly, it is clear that the spatula holder 150 can be rotated about the associated shaft 151 in synchronism with the rotation of the drive transmitting shaft 130 at the same time as the hollow shaft 70 is rotated about its own longitudinal axis.

As hereinbefore described, the rotary turntable assembly 10 is rotatable about the support shaft 11 from the article receiving station back to article receiving station past the intermediate processing stations including the article delivery station and a film wrapping station. At the film wrapping station, a generally rectangular film F is turned around each cylindrical container X with its opposite end held in overlapping relationship with each other. These overlapping ends of the respective film F is retained in overlapping relationship by the film retaining spatula 50, in a manner as will be described later, and are subsequently fusion-bonded together when the film retaining spatula 50 is revolved from the inoperative position to the operative position as a result of the rotation of the hollow shaft 70 effected by the rotation of the drive transmitting shaft 130. For fusion-bonding the opposite ends of the generally rectangular film F turned around the cylindrical container X in cooperation with the film retaining spatula 50, a heater unit generally identified by 170 is employed for each rotary mount 32.

The heating unit 170 includes, in addition to the presser head 171 referred to hereinbefore in connection with the article receiving block 31, a heater 172 built in the presser head 171 to heat the latter to a temperature generally required for the film F to be fused. The heater unit 170 is supported for movement between the retracted and projected positions in a direction radially of the rotary turntable assembly 10 by means of upper and lower link mechanism each comprising a pair of upper or lower links 178 and 179 which extend parallel to each other. While shafts 173 and 174 spaced a distance from each other in a direction perpendicular to the support shaft 11 slightly extend through the heater unit 170 with their respective opposite ends protruding upwardly and downwardly therefrom, the upper and lower links 178 are rotatably connected at one end with the opposite ends of the shaft 173 and at the other end with the drive transmitting shaft 130. Similarly, the upper and lower links 179 are rotatably connected at one end with the opposite ends of the shaft 174 and at the other end with a rotary shaft 175 having its opposite ends journalled respectively to the upper and intermediate turntables 12 and 13 by means of associated bearings 176 and 177, it being, however, to be noted that only the upper end of the rotary shaft 175 extends through the associated bearing 176, carried by the upper turntable 12, so as to terminate above the upper turntable 12. As a matter of design, the rotary shaft 175 is spaced from the drive transmitting shaft 130 a distance equal to the distance between the shafts 173 and 174.

A trigger lever 180 for each rotary shaft 175 is rigidly mounted on the upper end of the respective rotary shaft 175 for rotation together therewith so as to extend therefrom in a direction perpendicular to the longitudinal axis of the rotary shaft 175. The free end of the trigger lever 180 carries a trigger pin 181 loosely inserted therein, which trigger pin 181 is engageable with a drive mechanism (not shown) so designed as to reciprocately rotate the trigger pin 181 through a predetermined angle. Thus, it will readily be seen that, when the trigger pin 181 is rotated by the drive mechanism (not shown) in one direction through the predetermined angle, the rotary shaft 175 is rotated so as to cause the heater unit 170 to move from the retracted position towards the projected position in synchronism with the revolution of the film retaining spatula 50 from the inoperative position towards the operative position, but when the trigger pin 181 is rotated by the same drive mechanism (not shown) in the opposite direction through the predetermined angle, the rotary shaft 157 is rotated so as to cause the heater unit 170 to move from the projected position towards the retracted position in synchronism with the revolution of the film retaining spatula 50 from the operative position back towards the inoperative position.

It is to be noted that, although in the foregoing example each of the heater units 170 employed one for each rotary mounted 32 has been described and shown as carried by the rotary turntable assembly 10, it may be positioned laterally outwardly of and in the vicinity of the outer perimeter of the rotary turntable assembly 10.

As best shown in FIG. 1, at the article receiving station, an article feeding mechanism is arranged which comprises an article feeder 200 through which cylindrical containers X are successively supplied towards the article receiving station, and a sprocket wheel 201 interposed between one end of the article feeder 200 adjacent the rotary turntable assembly 10 and the rotary turntable assembly 10 for feeding the cylindrical containers X one by one onto the respective article supports 30. For this purpose, the sprocket wheel 201 is rotatably mounted on a stationary shaft 201 so as to lie and partially protrude into the space between the upper and intermediate turntables 12 and 13 and has its peripheral portion formed with a plurality of recesses 203 spaced an equal distance from each other in a direction circumferentially thereof. As can readily be understood by those skilled in the art, the sprocket wheel 201 is rotated about the shaft 202 at a peripheral velocity substantially equal to the peripheral velocity of the rotary turntable assembly 10 so that the cylindrical containers S being fed along the article feeder 200 can be delivered by the sprocket wheel 203 one by one onto the respective article supports 30, particularly the respective rotary mounts 32.

The article receiving station is followed by a film supply station at which a film supply unit is disposed for supplying each film F onto the respective cylindrical container X mounted on the associated rotary mount 32 and being transported by the rotary turntable assembly 10 towards the article delivery station. The film supply unit comprises a film supply roll 210 rotatably mounted on a shaft 211 supported by the machine base or machine framework and a film feeder 212 operatively interposed between the film supply roll 210 and the rotary turntable assembly 10. The film feeder 212 includes a pair of spaced support rolls 213 and 214 and a generally endless film feed belt 215 drivingly trained between these support rolls 213 and 214, said film feed belt 215 being so designed as to retain the film F under suction on an outer surface of that operative run of the film feed belt 215 which confronts the the rotary turntable assembly 10. One of the support rolls 213 and 214 is operatively coupled with an electric motor (not shown) through a suitable reduction gear unit (also not shown) so that the film feed belt 215 can be driven in an direction perpendicular to the support shaft 11 with the operative run thereon running in a direction conforming to the direction of rotation of the rotary turntable assembly 10.

The film supply unit of the construction described above is so designed that the film F supplied from the film supply roll 210 is, during the movement of the film feed belt 215, sucked onto the operative run of the film feed belt 215 and is then, while retained on the operative run of the film feed belt 215 by the effect of a partial vacuum, transported by the film feed belt 215 towards one of the cylindrical containers X which is brought to the film supply station so that the film F can be turned around such one of the containers. As a matter of design, the film feed belt 215 is driven at a velocity equal to the peripheral velocity of the rotary turntable assembly 10 so that the film F and the associated cylindrical container X can be brought to the film supply station in synchronism with each other for the reason which will become clear from the subsequent description.

At the article delivery station, there is disposed an article take-out unit substantially identical in construction with the article feeder unit. More specifically, the article take-out unit comprises a delivery sprocket wheel 230 identical with the feed sprocket wheel 201 and rotatably mounted on a shaft 231, supported by the machine base or framework, and having a plurality of article receiving recesses 232, and a guide chute 233 identical in construction from the article feeder 200. As can readily be understood by those skilled in the art, the article take-out unit operates in a manner generally reverse to the article feeder unit. In other words, during the rotation of the delivery sprocket wheel 230 with the article receiving recesses 232 successively brought in alignment with the respective cylindrical articles X being successively brought to the article delivery station as a result of the rotation of the rotary turntable assembly 10, the cylindrical containers X are successively picked up by the delivery sprocket wheel 230 and then delivered onto the guide chute 233 leading to, for example, an article inspection station.

It is to be noted that, so far as the sprocket wheels 201 and 230 are of identical construction in all aspects, the both must be driven at the same velocity. However, the present invention is not limited to the use of the sprocket wheels 201 and 230 of identical construction, but the sprocket wheels 201 and 230 may have different diameter and/or the number of the article receiving recesses in one of the sprocket wheels 201 and 230 may differ from that in the other of the sprocket wheels 201 and 230 so far as the both are driven at the same peripheral velocity. It is also to be noted that a single drive mechanism may be employed for driving all of the sprocket wheels 201 and 230 and the film supply unit 212.

Hereinafter, the profile of the cam surface 101 in the cam barrel 100 and the operation of the film wrapping machine of the construction described hereinbefore will be described with particular reference to FIGS. 4(*a*) and 4(*b*). It is to be noted that FIG. 4(*a*) illustrates, in schematic partially sectioned top plan view, the sequence beginning from the supply of one of the cylindrical containers X onto the corresponding rotary mount 32 in the rotary turntable assembly 10 until such one of the cylindri-cal containers X has been completely wrapped with the film F, whereas FIG. 4(*b*) illustrate the sequence in schematic side view together with the shape of the cam surface 101.

Figure 4:
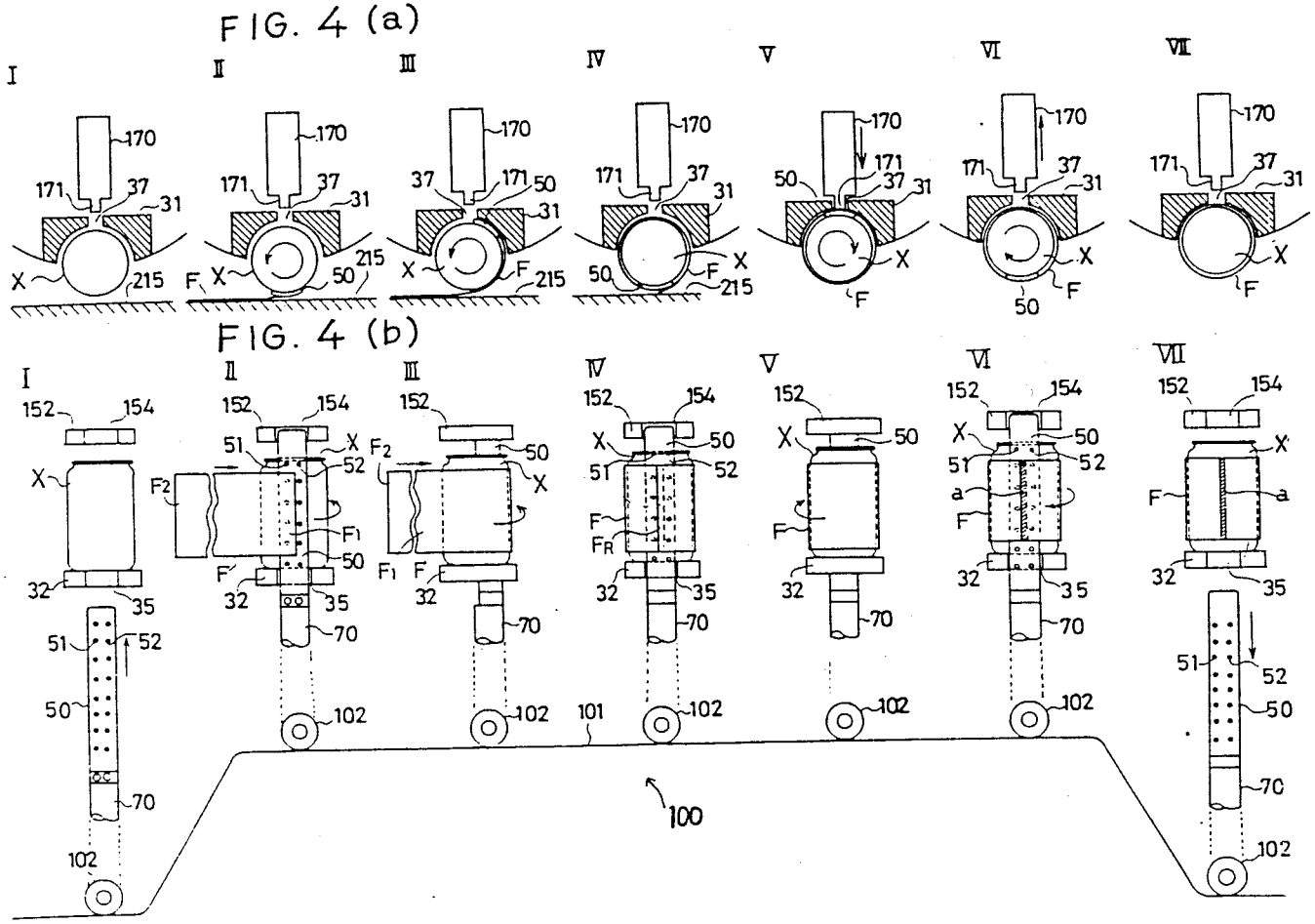
FIG. 4(*a*) is a schematic top plan view, with a portion shown in section, showing the sequence in which each film is turned around the respective container during the rotation of a rotary turntable assembly used in the film wrapping machine of FIG. 1.

Assuming that the rotary turntable assembly 10 is driven counterclockwise, as viewed in FIG. 1, about the support shaft 11, and when one of the article supports 30 in the rotary turntable assembly 10 is brought into alignment with the article supply station, the corresponding film retaining spatula 50 is held in the inoperative position and the associated hollow shaft 70 carrying such film retaining spatula 50 is held in the lowered position as shown by I in FIG. 4(*b*). So long as the hollow shaft 70 is held in the lowered position, the associated film retaining spatula 50 in the inoperative position has its top end situated below the associated rotary mount 32. During this condition, both of the arcuate opening 35 in each rotary mount 32 and the associated holder recess 154 in the disc 150 positioned immediately above said arcuate opening 35 in alignment therewith are exactly aligned with the film retaining spatula 50 then held in the inoperative position as clearly shown by I in FIG. 4(*b*). Also, as shown by I in FIG. 4(*a*), the associated heater unit 170 is held in the retracted position.

When one of the cylindrical containers X being successively fed by the feed sprocket wheel 201 is mounted on a corresponding one of the rotary mount 32 of the article support 30 then aligned with the article supply station, the hollow shaft 70 starts its ascending motion from the lowered position towards the raised position because of the roller 102 rolling on an upwardly inclined area of the cam surface 101 as can be understood from FIG. 4(*b*). Simultaneously therewith, the film retaining spatula 50 associated with such rotary mount 32 and carried by such hollow shaft 70 is lifted, passing through the arcuate opening 35 in the rotary mount 32 until it is inserted into the holder recess 154 in the associated disc 152. The ascending motion of the hollow shaft 70 resulting from the roller 102 rolling on the upwardly inclined area of the cam surface 101 terminates when the top end of the film retaining spatula 50 is received in the holder recess 154 as hereinbefore described. Simultaneously with tht termination of the ascending motion of the hollow shaft 70, the film retaining spatula 50 is communicated with the vacuum source to render the film retaining spatula 50 to be ready for retaining the film F under suction in a manner which will be described subsequently.

During the continued rotation of the rotary turntable assembly 10, the cylindrical container so mounted on the rotary mount 32 of the associated article support 30 is brought to the film supply station. As the film retaining spatula 50 still held in the inoperative position approaches the film supply station together with the cylindrical container X, a leading end $F_1$ of the film F being fed by the film feed belt 215 in the manner as hereinbefore described is aligned with a leading row of the suction perforations 51 in the film retaining spatula, it being to be noted that the term "leading" hereinabove and hereinafter used is in relation to the direction of movement of the film feed belt 215 or the rotary turntable assembly 10.

As soon as the leading row of the suction perforations 51 is aligned with the leading end $F_1$ of the film F, the film F is removed from the film feed belt 215 and then sucked onto the film retaining spatula 50 as shown by II in FIGS. 4(*a*) and 4(*b*). At this time, the trailing row of the suction perforations 52 in the film retaining spatula 50 are open to the atmosphere and will subsequently work with the trailing end $F_2$ of the same film F as will be described later.

Simultaneously with the suction of the leading end $F_1$ of the film F onto the film retaining spatula 50 in the manner as hereinabove described, the hollow shaft 70 in the raised position is driven in one direction to cause the film retaining spatula 50 to move from the inoperative position towards the operative position about the longitudinal axis of the hollow shaft 70 together with the associated rotary mount 32 supporting the cylindrical container X. As the film retaining spatula 50 is so moved, the film F retained by the film feed belt 215 is progressively peeled off from the film feed belt 215 while being turned around the cylindrical container X on the associated rotary mount 32 as shown by III in FIGS. 4(*a*) and 4(*b*). This is possible because the film retaining spatula 50 is passed through the arcuate opening 35 in the rotary mount 32 and received in the holder recess 154 in the disc 152 when and so long as the hollow shaft 70 is moved to the raised position, enabling both of the rotary mount 32 and the disc 152 to be rotated together with the revolution of the film retaining spatula 50 between the inoperative and operative positions, it being to be noted that the inoperative and operative positions of the film retaining spatula 50 is spaced substantially 540° about the longitudinal axis of the hollow shaft 70 for the purpose which will now be described.

When the film retaining spatula 50 being moved from the inoperative position towards the operative position about the longitudinal axis of the hollow shaft 70 revolves substantially 360° about the longitudinal axis of the hollow shaft 70, the trailing row of the suction perforations 52 are brought into alignment with a portion of the film F adjacent the trailing end $F_2$ thereof F having substantially turned around the cylindrical container X, permitting the film F to be completely removed from the film feed belt 215 with the trailing end $F_2$ consequently sucked onto the film retaining spatula 50 so as to overlap the leading end $F_1$ of the same film F, as shown by IV in FIGS. 4(*a*) and 4(*b*). In this condition, the film F so turned around the cylindrical container X represents a generally tubular shape enough to surround the cylindrical container X. Thereafter, the film retaining spatula 50 retaining the leading and trailing ends $F_1$ and $F_2$ in overlapping relation to each other continues its movement towards the operative position about the longitudinal axis of the hollow shaft 70 to bring the overlapping ends $F_1$ and $F_2$ of the film into alignment with the slot 37 in the associated article receiving block 30 substantially as shown by V in FIGS. 4(*a*) and 4(*b*).

Simultaneously with the arrival of the film retaining spatula 50 at the operative position after having completed its 540° revolution, the associated heater unit 170 is moved from the retracted position towards the projected position to permit the presser head 171 to project through the slot 37 in the article receiving block 31 so that the presser head 171 is brought into contact with the overlapping ends $F_1$ and $F_2$ of the film F as shown by V in FIGS. 4(*a*) and 4(*b*) with the consequence that the overlapping ends $F_1$ and $F_2$ of the film F are sandwiched between the film retaining spatula 50 and the presser head 171 of the heater unit 170. The contact of the presser head 171 with the overlapping ends $F_1$ and $F_2$ of the film F results in the fusion-bonding of the overlapping ends $F_1$ and $F_2$ to provide a joint a substantially as shown by VI in FIG. 4(*b*).

After the formation of the joint a at the overlapping ends $F_1$ and $F_2$ of the film F, the heater unit 170 is moved back towards the retracted position, leaving the film tube Fa in the form as surrounding the associated cylindrical container X. It is to be noted that, where the film used is made of a material having no capability of being fusion-bonded, an adhesive applicator may be employed for applying a layer of adhesive or bonding agent between the overlapping ends $F_1$ and $F_2$ of the film prior to the movement of the heater unit 170 from the retracted position towards the projected position so that, when the heater unit 170 is eventually moved towards the projected position, the presser head 171 can cooperate with the film retaining spatula 50 to firmly bond the overlapping ends $F_1$ and $F_2$ of the film together. In such case, the presser head 171 may not have the heater or heater built therein.

After the complete formation of the joint a in the film tube Fa, that is, the film F having its opposite ends $F_1$ and $F_2$ fusion-bonded together, the hollow shaft 70 is further rotated substantially 180° to permit the film retaining spatula 50 to return to the inoperative position accompanied by the rotation of the associated cylindrical container X together with the film tube Fa surrounding such cylindrical container X as shown by VI in FIGS. 4(*a*) and 4(*b*). Shortly before or substantially simultaneously with the return of the film retainining spatula 50 to the inoperative position in the manner as hereinabove described, the film retaining spatula 50 is disconnected from the vacuum source (not shown), and thereafter, the hollow shaft 70 starts its descending motion towards the lowered position accompanied by a corresponding descending motion of the film retaining spatula 50. Therefore, the film retaining spatula 50 positioned in a space between the outer peripheral surface of the cylindrical container X and the film tube Fa is withdrawn downwardly out of such space as shown by VII in FIGS. 4(*a*) and 4(*b*). This is possible because the roller 102 descends along a portion of the cam surface 101 which is downwardly inclined as shown in FIG. 4(*b*).

Thus, it will readily be seen that, during the passage of the rotary turntable assembly 10 past the film supply station, process steps of lifting the film retaining spatula 50, receiving the film F from the film feed belt 215, turning the film F around the cylindrical container X, bonding the overlapping ends $F_1$ and $F_2$ of the film F so turned around the cylindrical container X, and withdrawing the film retaining spatula 50 out of the space between the cylindrical container X and the film tube Fa are performed sequentially.

Figure 5:
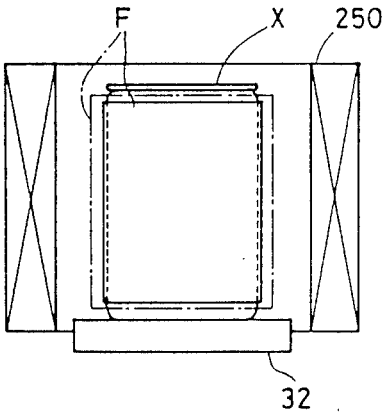
FIG. 5 is a schematic side view showing an example in which the film turned around the respective container is heat-treated to permit the film to be heat-shrunken.

Thereafter, and during the further continued rotation of the rotary turntable assembly 10 about the support shaft 11, the cylindrical containers X are successively brought to the article delivery station at which the cylindrical containers X wrapped loosely with the respective film tubes Fa are delivered by the delivery sprocket wheel 230 one by one onto the delivery chute 233 while each empty rotary mount 32 of the associated article support 30 is allowed to return to the article receiving station. The delivery chute 233 may be of any known construction with or without a conveyance belt used, and along this delivery chute 233 is moved a row of the cylindrical containers X having the respective film tubes Fa loosely wrapped therearound. The row of the cylindrical containers X are transported to a heat treating station at which the cylindrical containers X are successively heat-treated by any suitable heating means 250 as shown in FIG. 5, for example, applying a blast of heated air or by radiating infrared rays of light, to permit the film tubes Fa to heat-shrink, thereby completing the film wrapping. After this heat-treatment, each film tube Fa is heat-shrunken to encircle the respective cylindrical container X under interference-fit.

In describing the film wrapping machaine according to the foregoing embodiment of the present invention, reference has been made to the cylindrical container X. However, it is to be noted that the machine accordidng to the present invention can work satisfactorily with any type of articles, for example, containers of a shape having a generally barrel-shaped or ball-shaped body or of a shape wherein the body is swelling and the mouth is progressively constricted from the body. Where the container of the shape wherein the body is swelling and the mouth is progressively constricted from the body (which container is hereinafter referred to as a "swelling container"), it may happen that the film turned around the swelling container will not retain its shape because of the lack of the self-supporting capability resulting from the flexibility of the film and, therefore, the high speed wrapping of the films around the swelling containers will be somewhat hampered. This possibility can be minimized by the use of the wrapping machine according to any one of the second and third preferred embodiments of the present invention which will now be described.

Figure 6:
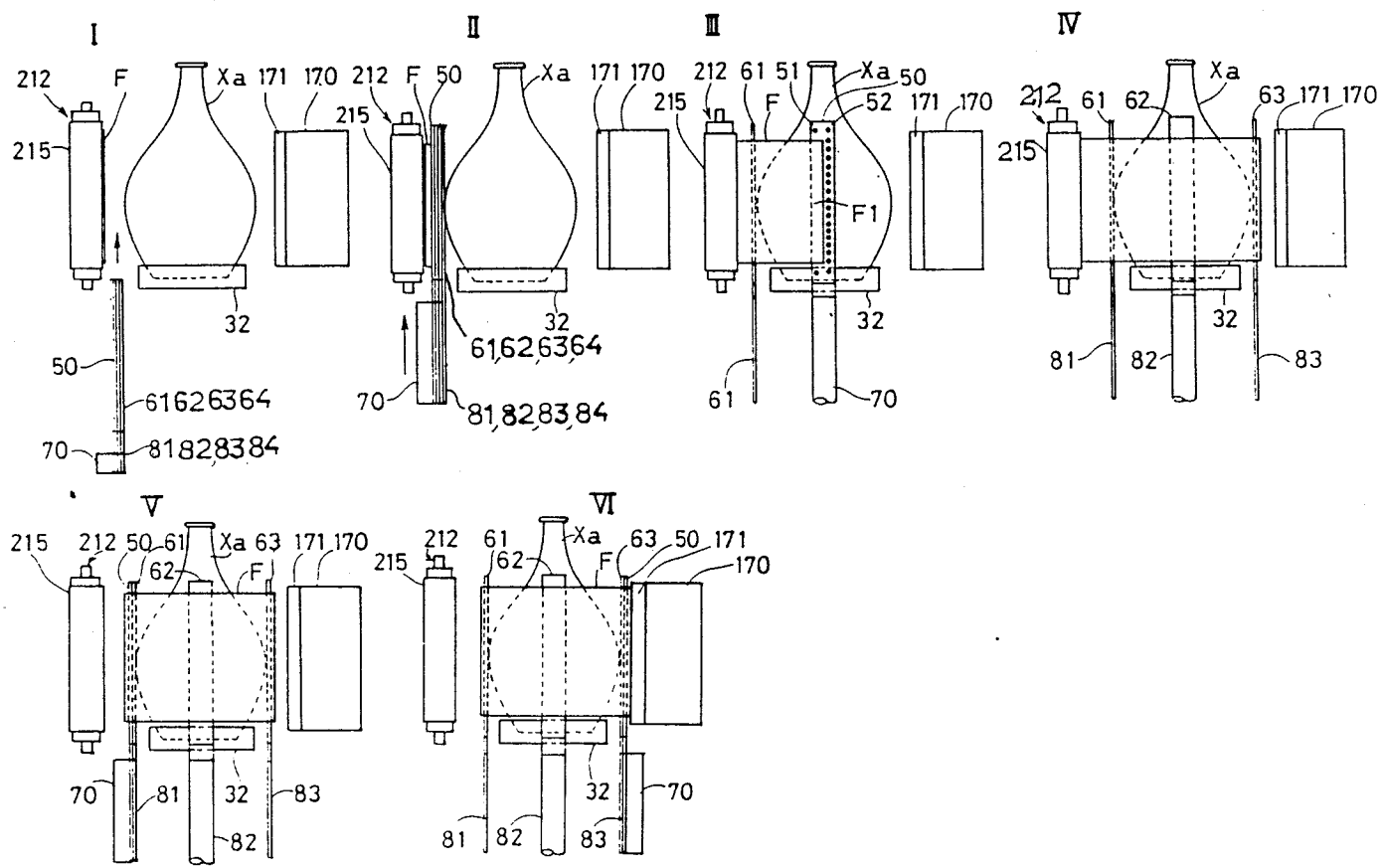
FIGS. 6(*a*) and 6(*b*) are views similar to FIGS. 4(*a*) and 4(*b*), respectively, showing the operation of the film wrapping machine according to a second preferred embodiment of the present invention.
Figure 6B:
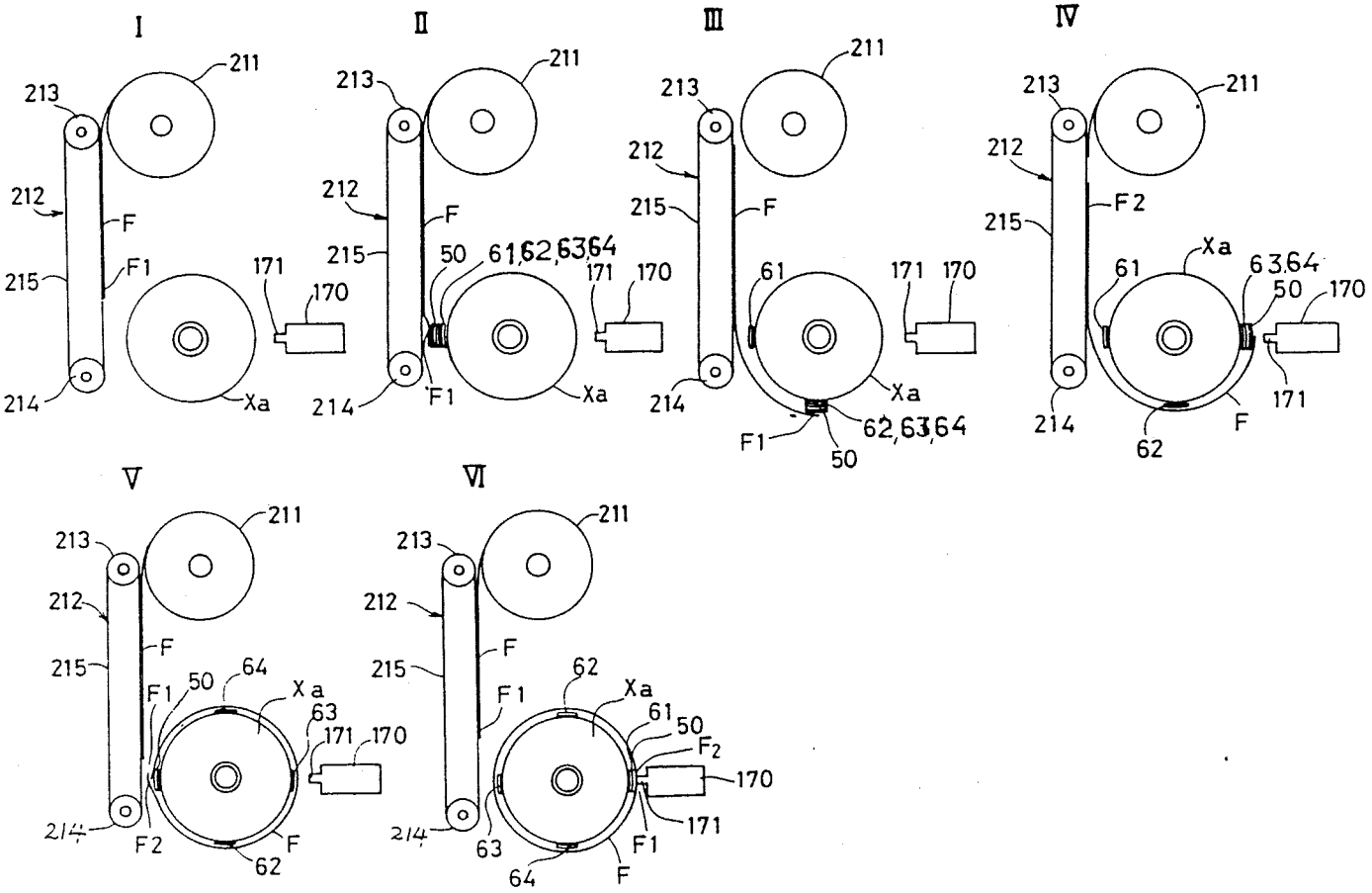

FIGS. 6(*a*) and 6(*b*), as is the case with FIGS. 4(*a*) and 4(*b*), illustrate the sequence beginning from the supply of one of the swelling containers Xa onto the corresponding rotary mount 32 in the rotary turntable assembly 10 until such one of the swelling container Xa has been completely wrapped with the film. In describing the second preferred embodiment of the present invention with reference to FIGS. 6(*a*) and 6(*b*), only the difference between the previously described embodiment and the second embodiment will be described for the sake of brevity.

Referring now to FIGS. 6(*a*) and 6(*b*), a plurality of, for example, four, strip-like erecting rods 61, 62, 63 and 64, which may be similar in shape to the film retaining spatula 50, are employed for each article support 30 in the rotary turntable assembly 10. These erecting rods 60 are operable to support the film F which has been turned around each swelling container Xa. When and so long as the film retaining spatula 50 is held in the inoperative position regardless of the position of the hollow shaft 70, the erecting rods 61 to 64 are folded together with the film retaining spatula 50 as if they altogether represent a single rod-like integer. On the other hand, the erecting rods 61 to 64 in the folded condition as hereinabove described can move together with the film retaining spatula 50 in a direction parallel to the support shaft 11. Also, as the subsequent description makes it clear, the erecting rods 61 to 64 can be unfolded, as the film retaining spatula 50 is revolved 360° from the inoperative position towards the operative position so that the erecting rods 61 to 64 can be positioned radially outwardly of the associated swelling container Xa in circumferentially equally spaced relationship with each other about the associated swelling container Xa while one of the erecting rods is held in overlapping relationship with the film retaining spatula 50.

More specifically, when one of the swelling containers Xa is fed onto the rotary mount 32 of one of the article support 30 then aligned with the article supply station as shown by I in FIGS. 6(*a*) and 6(*b*), the film retaining spatula 50 is lifted as a result of the movement of the hollow shaft 70 from the lowered position towards the raised position, accompanied by a corresponding upward movement of the erecting rods 61 to 64 in folded condition.

Then, as shown by II in FIGS. 6(*a*) and 6(*b*), the leading end $F_1$ of the film F is sucked onto the film retaining spatula 50 positioned radially outwardly of the erecting rods 61 to 64 with respect to the swelling container Xa on the rotary mount 32 as a result of the communication of the film retaining spatula 50 with the vacuum source, and substantially simultaneously therewith, the film retaining spatula 50 starts its revolution from the inoperative position towards the operative position at a speed synchronized with the speed of movement of the film feed belt 215 as shown by III in FIGS. 6(*a*) and 6(*b*). Subsequent to the start of movement of the film retaining spatula 50 towards the operative position, one of the erecting rods which is positioned closest to the swelling container Xa, that is, the erecting rod 61 is left at a position between the film feed belt 215 and the swelling container Xa without being moved together with the film retaining spatula 50.

After the film retaining spatula 50 being moved towartds the operative position has completed its 90° revolution about the swelling container Xa, the erecting rod 62 which has been positioned next to the erecting rod 61 when in the folded condition is left at a position spaced 90° from the position where the erecting rod 61 is held still, that is, the inoperative positoin of the film retaining spatula 50, as shown by IV in FIGS. 6(*a*) and 6(*b*). Similarly, as the film retaining spatula 50 completes 180° and 270° rotations from the inoperative position about the swelling container Xa as shown by IV and V in FIGS. 6(*a*) and 6(*b*), the erecting rods 63 and 64 are left at respective positions spaced 180° and 270° from the inoperative position.

As has been described in connection with the previous embodiment of the present invention, when the film retaining spatula 50 has completed about 360° rotation, the film F fed by the film feed belt 215 is completely removed from the film feed belt 215 with the trailing end $F_2$ thereof sucked onto the film retaining spatula 50, as shown by V in FIG. 6(*b*), thus overlapping the leading end $F_1$ thereof.

Thereafter, the film retaining spatula 50 further continues its revolution towards the operative position without being accompanied by the movement of any one of the erecting rods 61 to 64 which are left spaced 90° from each other in a direction circumferentially of the swelling container Xa. These erecting rods 61 to 64 so positioned circumferentially of the swelling container Xa and inside the film F turned around the swelling container Xa cooperate together to substantially avoid, or minimize, the deformation of local portions of the film F so turned around the swelling container Xa while supporting the film F.

Upon the arrival of the film retaining spatula 50 having the overlapping ends $F_1$ and $F_2$ of the film F retained thereby, the heater unit 170 is moved from the retracted positon towards the projected position with the presser head 171 consequently pressed against the film retaining spatula 50 to effect the fusion-bonding of the overlapping ends $F_1$ and $F_2$ of the film F to complete the film tube Fa as hereinbefore described in connection with the previous embodiment of the present invention and as shown by VI in FIGS. 6(*a*) and 6(*b*).

In the embodiment shown in and described with reference to FIGS. 6(*a*) and 6(*b*), each of the rotary mount 32 is shown as having a diameter smaller than the diameter of the circular path along which the film retaining spatula 50 is moved between the inoperative and operative positions. In such case, during the revolution of the film retaining spatula 50, a friction may take place between the outer peripheral surface of the body of the swelling container Xa and the film F turned therearound. Where this friction is desired to be avoided, each rotary mount 32 may be made rotatable about and together with the associated hollow shaft 70 to render the swelling container Xa on the rotary mount 32 to rotate.

After the formation of the film tube Fa with the film retaining spatula 50 and the heater unit 170 positioned at the operative position and the projected position, respectively, the communication between the film retaining spatula 50 and the vacuum source through the hollow of the hollow shaft 70 is interrupted, and all of the film retaining spatula 50 and the erecting rods 61 to 64 are withdrawn downwards out from the annular space between the outer peripheral surface of the body of the swelling container Xa and the film tube Fa. The swelling container Xa having the film tube Fa mounted thereon are then fed to the heat treating station in the manner as hereinbefore described in connection with the previous embodiment so that the film tube Fa can be heat-shrunken to complete the film wrapping.

The erecting rods 61 to 64 operable in the manner as hereinbefore described with particular reference to FIGS. 6(*a*) and 6(*b*) are mounted on a corresponding number of support rods 81, 82, 83 and 84 for movement together therewith, or otherwise integrally formed therewith. The support rods 81 to 84 are supported for movement between lowered and raised positions and also for rotation about the longitudinal axis of the respective swelling container Xa mounted on the associated article support mount 32. The movement of the support rods 81 to 84 between the lowered and raised positions, and hence, that of the erecting rods 61 to 64, is synchronized with the hollow shaft 70 whereas the angular movement of the support rods 81 to 84 about the longitudinal axis of the respective swelling container Xa and exteriorly around the associated article support mount 32 is synchronized with the angular movement of the film retaining spatula 50. For this purpose, although not shown, a drive mechanism and its associated linkage system which are separate for those associated with the film retaining spatual 50 are used to move the erecting rods 61 to 64 as well as the support rods 81 to 84

It is to be noted that the support rods 81 to 84 which have been described as comprised of the members separate from the erecting rods 61 to 64 may be integral extensions of the respective erecting rods 61 to 64, that is, may be integrally formed with the respective erecting rods 61 to 64.

Instead of the use of the film retaining spatula, which has been described in connection with the first embodiment shown in FIGS. 1 to 5, or the foldable erecting rods in combination with the film retaining spatula which have been described in connection with the embodiment shown in FIGS. 6(*a*) and 6(*b*), a cylindrical film retaining barrel may be employed which will now be described with reference to FIGS. 7(*a*) and 7(*b*) and 8. The use of the cylindrical film retaining barrel, generally identified by 50*a*, in the film wrapping machine according to the present invention is advantageous in that the film turned around the container can be satisfactorily supported regardless of the shape of the container desired to be handled by the film wrapping machine.

Figure 7:
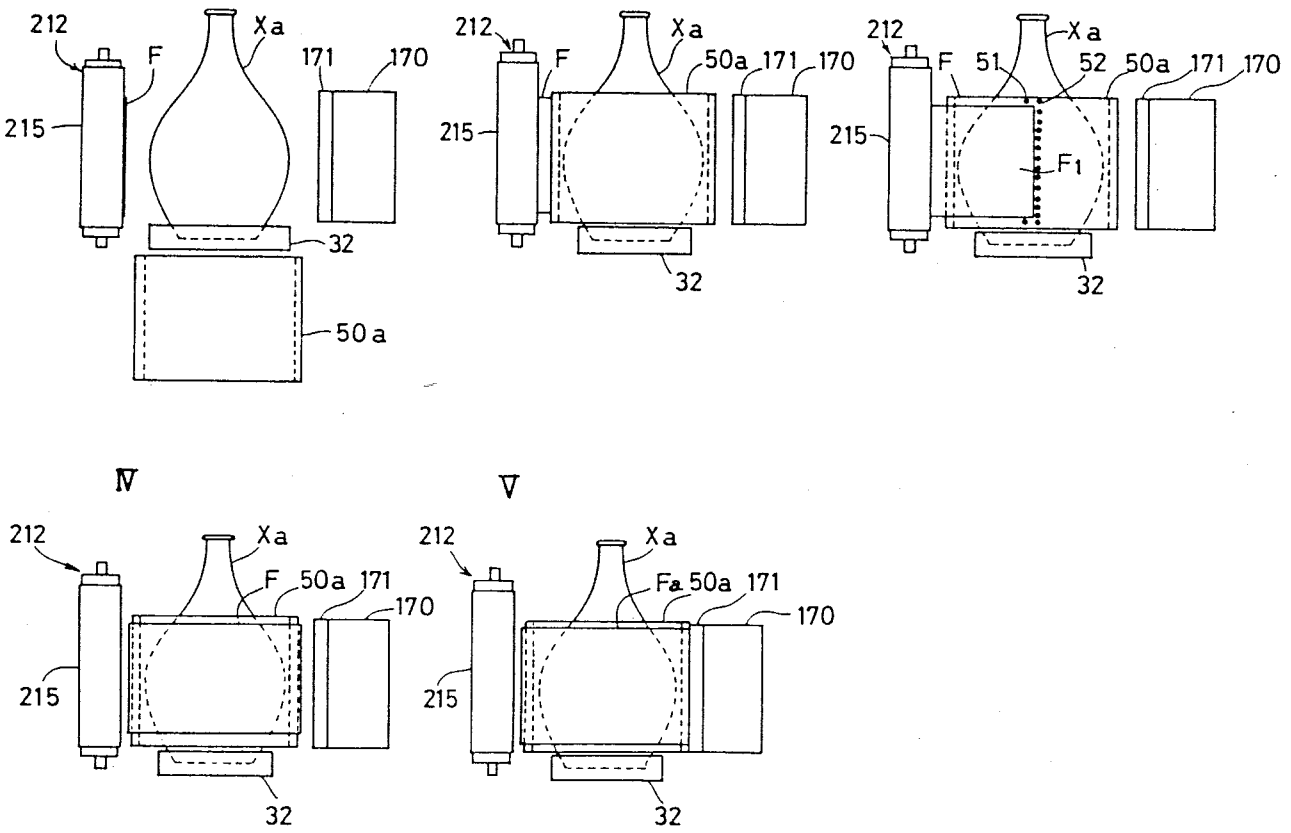
FIGS. 7(*a*) and 7(*b*) are views similar to FIGS. 4(*a*) and 4(*b*), respectively, showing the operation of the film wrapping machine according to a third preferred embodiment of the present invention.
Figures 7B, 8:
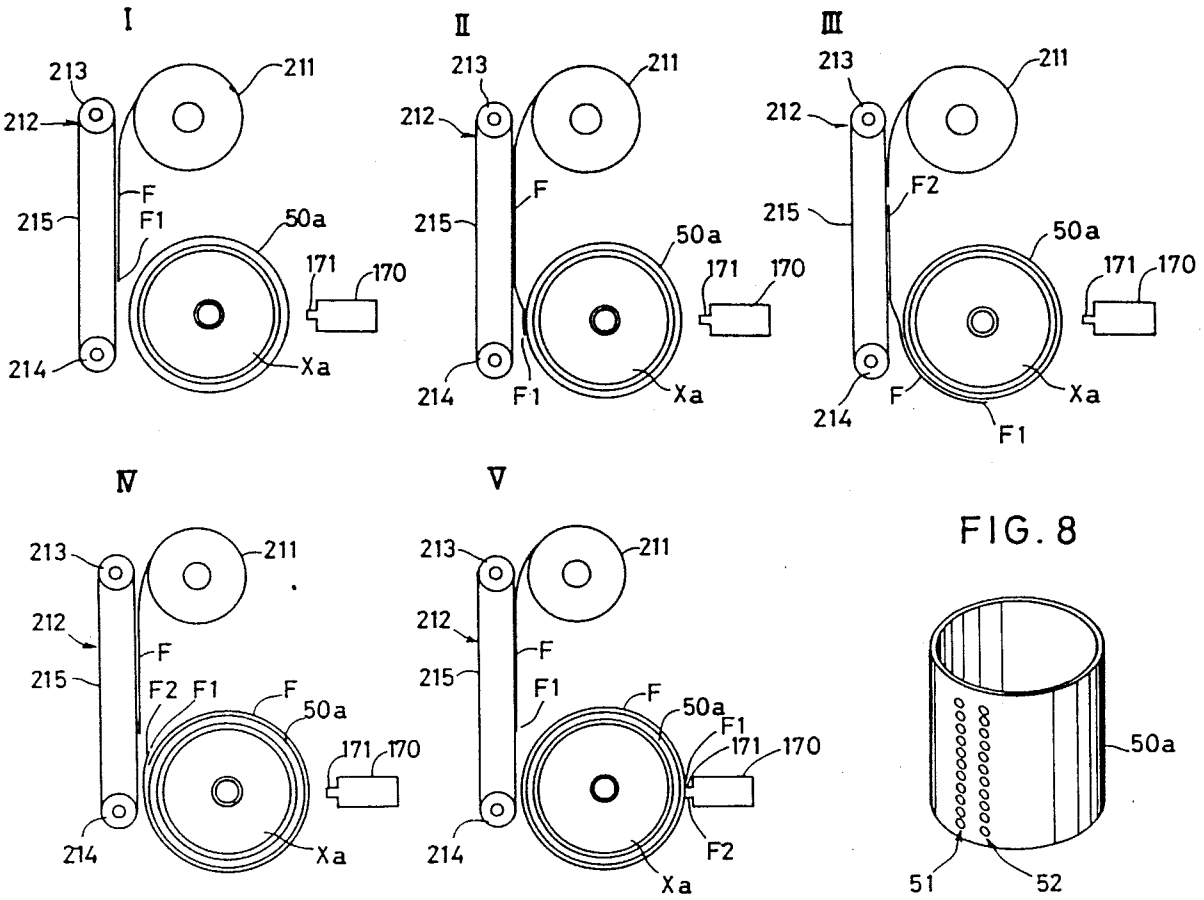
FIG. 8 is a perspective view of a film retaining barrel used in the machine according to the third embodiment of the present invention.
Figure 9:
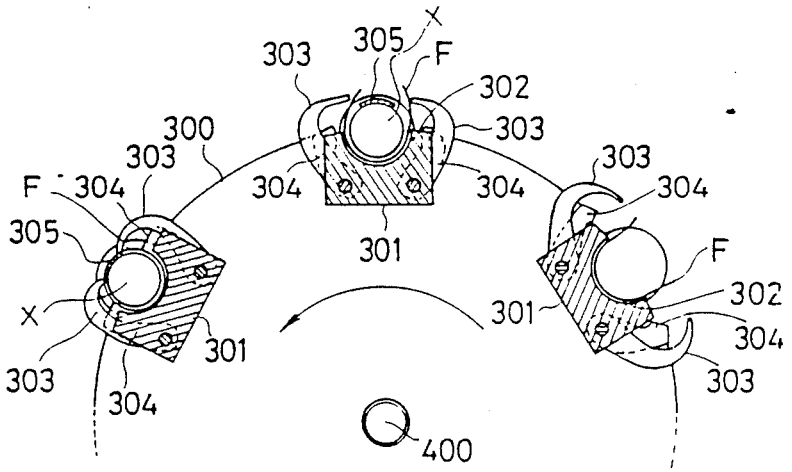
FIG. 9 Prior art
FIG. 9 is a schematic fragmental top plan view of the prior art film wrapping machine.

Referring to FIG. 7, the cylindrical film retaining barrel 50*a* has a length and an inner diameter sufficient to accommodate therein any one of the containers desired to be handled by the film wrapping machine according to the present invention. As best shown in FIG. 8, a portion of the cylindrical film retaining barrel 50*a* has two rows of suction perforations 51 and 52 defined on the outer peripheral surface thereof so as to extend in a direction axially of the cylindrical barrel 50*a*, and while the cylindrical barrel 50*a* is rigidly mounted on the hollow shaft 70 in coaxial relationship with the associated rotary mount 32 through the coupling member 72 for rotation together therewith, each row of the suction perforations 51 and 52 are communicated with the center hollow 71 in the hollow shaft 70 by way of the connecting passage 73 in the connecting member 72 via a respective axial passage (not shown) defined in the wall of the cylindrical barrel 50*a*.

It is to be noted that, instead of the use of the rows of the suction perforations 51 and 52, slits may be employed and that one or two additional rows of suction perforations may be formed on another portion of the outer peripheral surface of the cylindrical barrel 50*a* circumferentially spaced about 150° from that portion thereof where the rows of the suction perforations 51 and 52 in a fashion similar to the two rows of the suction perforations 51 and 52 so that the film F subsequently turned around the respective container can be positively supported by the cylindrical barrel 50*a* sucking a portion of the film F generally intermediate between the opposite ends $F_1$ and $F_2$ thereof which are then sucked by the rows of the suction perforations 51 and 52.

The film wrapping machine according to the third embodiment of the present invention operates in a manner substantially similar to the film wrapping machine according to any one of the foregoing embodiments. More specifically, assuming that one of the containers, for example, the containers Xa is mounted on the associated rotary mount 32 then aligned with the article supply station during the rotation of the rotary turntable assembly 10 as shown by I in FIGS. 7(*a*) and 7(*b*), the associated cylindrical barrel 50*a* is upwardly moved to permit the container Xa to be situated inside the cylindrical barrel 50*a* substantially as shown by II in FIG. 7(*a*).

During the continued rotation of the rotary turntabel assembly 10, and at the film supply station, the leading row of the suction perforations 51 in the cylindrical barrel 50*a* communicated with the vacuum source is brought into alignment with, and then suckes, the leading end $F_1$ of the film F being supplied by the film feed belt 215 as shown by II in FIG. 7(*b*). Upon the rotation of the cylindrical barrel 50*a* about the longitudinal axis of the hollow shaft 70, the film F having its leading end $F_1$ sucked by the cylindrical barrel 50*a* in the manner as hereinabove described is pulled outwards from the film feed belt 215 while being turned around the cylindrical barrel 50*a* as shown by III in FIGS. 7(*a*) and 7(*b*).

At the time the cylindrical film retaining barrel 50*a* has substantially completed 360° rotation, the trailing row of the suction perforations 52 is brought into alignment with a portion of the film F adjacent the trailing end $F_2$ to attract said trailing end $F_2$ towards the cylindrical barrel 50*a* by the effect of a suction force. Thus, as shown by IV in FIGS. 7(*a*) and 7(*b*), the film F is completely turned around the cylindrical film retaining barrel 50*a* with the trailing end $F_2$ overlapping the leading end $F_1$ of the same film F.

Thereafter, the cylindrical film retaining barrel 50*a* is rotated a further 150° towards the operative positon. As the cylindrical film retaining barrel 50*a* approaches the operative position, the heatee unit 170 in the retracted position is moved towards the projected position, and simultaneously with the arrival of the cylndrical film retaining barrel 50*a*, the presser head 171 of the heate runit 170 is pressed against the cylindrical barrel 50*a* to effect the fusion-bonding of the overlapping ends $F_1$ and $F_2$ to complete the formation of the film tube Fa as shown by V in FIGS. 7(*a*) and 7(*b*)

As is the case with any one of the foregoing embodiments, after the formation of the film tube Fa, the cylindrical film retaining barrel 50*a* is withdrawn downwards leaving the film tube Fa in the form as surrounding the container Xa, and the container Xa wrapped with the film tube Fa is subsequently transferred to the heat-treating station through the delivery station at which it is removed from the rotary turntable assembly 10 onto the delivery chute 233 by means of the delivery sprocket wheel 230. It is to be noted that, shortly before the downward movement of the cylindrical film retaining barrel 50*a* subsequent to the formation of the film tube Fa, the communication between the suction perforations 51 and 52 and the vacuum source is interrupted.

It is to be noted that, instead of the cylindrical film retaining barrels 50*a*, a similar film retaining barrels of generally square cross-sectional shape may be employed if the containers desired to be wrapped with the heat-shrikable films have a generally square cross-section.

Although the present invention has been fully described in connection with the preferred embodiments thereof with reference to the accompanying drawings, it is to be noted that various changes and modifications are apparent to those skilled in the art. Some of the changes or modifications have been described, and such and other changes and/or modifications are to be construed as included within the scope of the present invention as defined by the appended claims unless they depart therefrom.

What is claimed is:

1. A film wrapping machine for successively turning films around articles so as to form a film tube encircling each article, which machine comprises:

a rotary turntable assembly supported for rotation in one direction about a support shaft, said rotary turntable assembly being, during one complete rotation, movable from and back to an article supply station past a film supply station and an article delivery station, all of said stations being disposed in the vicinity of the periphery of of the rotary turntable assembly;

a plurality of article supports provided in the rotary turntable assembly at a peripheral portion thereof for rotation together with said rotary turntable assembly about the support shaft, said article supports being spaced an equal distance from each other in a direction circumferentially of the rotary turntable assembly, each of said article support being operable to carry the respective article during the rotation of the rotary turntable assembly;

an article supply unit disposed at the article supply station for supplying the articles successively onto the respective article supports in the rotary turntable assembly as the rotary turntable assembly during the rotation thereof arrives at the article supply station;

a film retaining member provided for each article support and supported in the vicinity of the respective article support for rotation about an axis parallel to the support shaft between inoperative and operative positions and also for movement in a direction parallel to the support shaft between raised and lowered positions, said film retaining member having suction openings defined therein in at least two leading and trailing rows, the leading and trailing rows of the suction openings being spaced a predetermined distance from each other in a direction conforming to the direction of rotation of the film retaining member, said leading row of the suction openings being adapted to retain a leading end of the associated film by the effect of a suction force whereas the trailing row of the suction openings is adapted to retain a trailing end of such associated film by the effect of a suction force, said film retaining member being rotatable about the associated article on the article support from the inoperative position towards the operative position only when and after it has been moved from the lowered position towards the raised position;

a film supply unit disposed at the film supply station for supplying the film onto the respective film retaining member each time the rotary turntable assembly is brought to the film supply station, said film retaining member being moved from the lowered position to the raised position upon the arrival of the rotary turntable assembly at the film supply station such that the leading end of the film can be sucked by the leading row of the suction openings by the effect of the suction force, the film with its leading end sucked by the leading row of the suction openings being exteriorly turned around the associated article as the film retaining member is rotated from the inoperative position towards the operative position, said film being completely turned around the associated article with a portion of the film adjacent the trailing end sucked by the trailing row of the suction openings permitting the trailing end to overlap the leading end;

a heater unit provided for each article support and carried by the rotary turntable assembly for movement between projected and retracted positions in a direction close towards and away from the associated article on the article support, said respective heater unit being moved from the retracted position to the projected position in unison with the movement of the associated film retaining member from the inoperative position to the operative position, said heater unit when moved to the projected position being pressed against the associated film retaining member with the overlapping ends of the film around the article consequently fusion-bonded together to complete a film tube; and an article delivery unit disposed at the article delivery station for removing the articles with the respective film tube successively out from the associated article supports as the rotary turntable assembly during its continued rotation is brought to the article delivery station.

2. The machine as claimed in claim 1, wherein the film retaining member comprises a film retaining spatula having a hollow defined therein and adapted to be communicated with a source of vacuum, and said leading and trailing rows of the suction openings being defined in communication with the hollow on one surface of the film retaining spatual facing in a direction opposite to the associated article.

3. The machine as claimed in claim 2, wherein the film retaining spatula comprises a pair of generally strip-like plates connected together in face-to-face relationship with each other, one of said plates having at least one recess defined therein while the other of the plates having the rows of the suction openings defined therein, said recess forming the hollow when the plates are connected together.

4. A film wrapping machine for successively turning films around articles so as to form a film tube encircling each article, which machine comprises:

a rotary turntable assembly supported for rotation in one direction about a support shaft, said rotary turntable assembly being, during one complete rotation, movable from and back to an article supply station past a film supply station and an article delivery station, all of said stations being disposed in the vicinity of the periphery of of the rotary turntable assembly;

a plurality of article supports provided in the rotary turntable assembly at a peripheral portion thereof for rotation together with said rotary turntable assembly about the support shaft, said article supports being spaced an equal distance from each other in a direction circumferentially of the rotary turntable assembly, each of said article support being operable to carry the respective article during the rotation of the rotary turntable assembly;

an article supply unit disposed at the article supply station for supplying the articles successively onto the respective article supports in the rotary turntable assembly as the rotary turntable assembly during the rotation thereof arrives at the article supply station;

a film retaining member provided for each article support and supported in the vicinity of the respective article support for rotation about an axis parallel to the support shaft between inoperative and operative positions and also for movement in a direction parallel to the support shaft between raised and lowered positions, said film retaining member having suction openings defined therein in at least two leading and trailing rows, the leading and trailing rows of the suction openings being spaced a predetermined distance from each other in a direction conforming to the direction of rotation of the film retaining member, said leading row of the suction openings being adapted to retain a leading end of the associated film by the effect of a suction force whereas the trailing row of the suction openings is adapted to retain a trailing end of such associated film by the effect of a suction force, said film retaining member being rotatable about the associated article on the article support from the inoperative position towards the operative position only when and after it has been moved from the lowered position towards the raised position;

a plurality of foldable erecting members for each film retaining member and similar in shape to the associated film retaining member, said foldable erecting members for each film retaining member being supported for movement together with the associated film retaining member, but being held in a folded condition when the associated film retaining member is in the lowered position and also in the inoperative position, said foldable erecting members being unfolded as the associated film retaining member is moved from the inoperative position towards the operative position about the associated article, said foldable erecting member when unfolded being spaced a distance from each other in a direction circumferentially of the associated article to support the film turned exteriorly around the associated article;

a film supply unit disposed at the film supply station for supplying the film onto the respective film retaining member each time the rotary turntable assembly is brought to the film supply station, said film retaining member being moved together with the foldable erecting members from the lowered position to the raised position upon the arrival of the rotary turntable assembly at the film supply station such that the leading end of the film can be sucked by the leading row of the suction openings by the effect of the suction force, the film with its leading end sucked by the leading row of the suction openings being exteriorly turned around the associated article in contact with the foldable erecting members as the film retaining member is rotated from the inoperative position towards the operative position, said film being completely turned around the associated article with a portion of the film adjacent the trailing end sucked by the trailing row of the suction openings permitting the trailing end to overlap the leading end;

a heater unit provided for each article support and carried by the rotary turntable assembly for movement between projected and retracted positions in a direction close towqards and away from the associated article on the article support, said respective heater unit being moved from the retracted position to the projected position in unison with the movement of the associated film retaining member from the inoperative position to the operative position, said heater unit when moved to the projected position being pressed against the associated film retaining member with the overlapping ends of the film around the article consequently fusion-bonded together to complete a film tube; and an article delivery unit disposed at the article delivery station for removing the articles with the respective film tube successively out from the associated article supports as the rotary turntable assembly during its continued rotation is brought to the article delivery station.

5. A film wrapping machine for successively turning films around articles so as to form a film tube encircling each article, which machine comprises:

a rotary turntable assembly supported for rotation in one direction about a support shaft, said rotary turntable assembly being, during one complete rotation, movable from and back to an article supply station past a film supply station and an article delivery station, all of said stations being disposed in the vicinity of the periphery of of the rotary turntable assembly;

a plurality of article supports provided in the rotary turntable assembly at a peripheral portion thereof for rotation together with said rotary turntable assembly about the support shaft, said article supports being spaced an equal distance from each other in a direction circumferentially of the rotary turntable assembly, each of said article support being operable to carry the respective article during the rotation of the rotary turntable assembly;

an article supply unit disposed at the article supply station for supplying the articles successively onto the respective article supports in the rotary turntable assembly as the rotary turntable assembly during the rotation thereof arrives at the article supply station;

a film retaining barrel provided for each article support and supported in the vicinity of the respective article support for rotation about an axis parallel to the support shaft between inoperative and operative positions and also for movement in a direction parallel to the support shaft between raised and lowered positions, said film retaining barrel having suction openings defined therein in at least two leading and trailing rows, the leading and trailing rows of the suction openings being spaced a predetermined distance from each other in a circumferential direction thereof, said leading row of the suction openings being adapted to retain a leading end of the associated film by the effect of a suction force whereas the trailing row of the suction openings is adapted to retain a trailing end of such associated film by the effect of a suction force, said film retaining barrel being rotatable about the associated article on the article support from the inoperative position towards the operative position only when and after it has been moved from the lowered position towards the raised position;

a film supply unit disposed at the film supply station for supplying the film onto the respective film retaining member each time the rotary turntable assembly is brought to the film supply station, said film retaining barrel being moved from the lowered position to the raised position upon the arrival of the rotary turntable assembly at the film supply station such that the leading end of the film can be sucked by the leading row of.the suction openings by the effect of the suction force, the film with its leading end sucked by the leading row of the suction openings being exteriorly turned around the associated film retaining barrel as the film retaining barrel is rotated from the inoperative position towards the operative position, said film being completely turned around the associated film retaining barrel with a portion of the film adjacent the trailing end sucked by the trailing row of the suction openings permitting the trailing end to overlap the leading end;

a heater unit provided for each article support and carried by the rotary turntable assembly for movement between projected and retracted positions in a direction close towqards and away from the associated article on the article support, said respective heater unit being moved from the retracted position to the projected position in unison with the movement of the associated film retaining barrel from the inoperative position to the operative position, said heater unit when moved to the projected position being pressed against the associated film retaining barrel with the overlapping ends of the film around the film retaining barrel consequently fusion-bonded together to complete a film tube; and an article delivery unit disposed at the article delivery station for removing the articles with the respective film tube successively out from the associated article supports as the rotary turntable assembly during its continued rotation is brought to the article delivery station.

* * * * *